United States Patent [19]

Darnell

[11] Patent Number: 4,718,888

[45] Date of Patent: Jan. 12, 1988

[54] CENTRIFUGE BOWL MOUNT

[75] Inventor: Lawrence W. Darnell, Cypress, Tex.

[73] Assignee: Cardiovascular Systems, Inc., The Woodlands, Tex.

[21] Appl. No.: 838,660

[22] Filed: Mar. 10, 1986

[51] Int. Cl.[4] ..... B04B 9/00

[52] U.S. Cl. ..... 494/85; 494/38; 494/84

[58] Field of Search ..... 366/209, 210, 211, 213, 366/214; 494/38, 39, 41, 43, 85, 84; 68/23 R; 210/360.1, 781, 782

[56] References Cited

U.S. PATENT DOCUMENTS

| | | | |
|---|---|---|---|
| 1,018,947 | 2/1912 | Wall | 366/213 |
| 2,662,687 | 12/1953 | Spross | 233/21 |
| 3,145,713 | 8/1964 | Latham, Jr. | 128/214 |
| 3,190,547 | 6/1965 | Shanley | 366/213 |
| 3,244,363 | 4/1966 | Hein . | |
| 3,317,127 | 5/1967 | Cole | 233/26 |
| 3,409,213 | 11/1968 | Latham, Jr. | 233/21 |
| 3,565,330 | 2/1971 | Latham, Jr. | 233/21 |
| 3,581,981 | 6/1971 | Latham, Jr. | 233/21 |
| 3,634,228 | 1/1972 | Latham, Jr. | 210/21 |
| 3,782,735 | 1/1974 | Novosad | 277/22 |
| 3,785,549 | 1/1974 | Latham, Jr. | 233/23 |
| 3,858,796 | 1/1975 | Unger . | |
| 3,987,961 | 10/1976 | Sinn et al. . | |
| 4,086,924 | 5/1978 | Latham, Jr. | 128/214 |
| 4,109,855 | 8/1978 | Brown et al. . | |
| 4,142,670 | 3/1979 | Ishimaru . | |
| 4,151,844 | 5/1979 | Cullis et al. . | |
| 4,256,313 | 3/1981 | Arnold | 277/11 |
| 4,300,717 | 11/1981 | Latham, Jr. | 233/1 A |
| 4,413,771 | 11/1983 | Rohde et al. . | |
| 4,413,772 | 11/1983 | Rohde et al. . | |
| 4,413,773 | 11/1983 | Rohde et al. . | |
| 4,622,029 | 11/1986 | Nilsson . | |

FOREIGN PATENT DOCUMENTS

| | | |
|---|---|---|
| 2302140 | 10/1976 | France . |
| WO84/01796 | 6/1985 | PCT Int'l Appl. . |
| WO84/01794 | 6/1985 | PCT Int'l Appl. . |
| 1044430 | 9/1966 | United Kingdom . |
| 2002266 | 2/1979 | United Kingdom . |
| 2003757 | 3/1979 | United Kingdom . |
| 2005163 | 4/1979 | United Kingdom . |
| 2013110 | 8/1979 | United Kingdom . |
| 2084051 | 4/1982 | United Kingdom . |
| 2098098 | 11/1982 | United Kingdom . |
| 2128904 | 5/1984 | United Kingdom . |
| 2168267 | 6/1986 | United Kingdom . |

OTHER PUBLICATIONS

"Packed Cells in 3 Minutes," brochure of Haemonetics Corp., dated prior to Mar. 10, 1985.

"Cell Saver 4 Autologous Blood Recovery System," brochure of Haemonetics Corp., dated prior to Mar. 10, 1985.

"Haemonetics," instructions for Haemonetics Corp. Unit, dated prior to Mar. 10, 1985.

Publication: Mollison "Blood Transfusion in Clinical Medicine" (1983) pp. 15–18, Centrifuge and Bowl, Shut-off Valve Having a Calibrated Outlet.

*Primary Examiner*—Robert W. Jenkins

*Attorney, Agent, or Firm*—Vaden, Eickenroht, Thompson & Boulware

[57] ABSTRACT

A centrifuge bowl mount with a base and having one or more toggle members disposed thereon which are movable from a non-contact or non-engaging first positon to a contact or engaging second position in which they either (a) contact or engage the bowl or (b) move other members such as seal members disposed on the base or move push membes which in turn move the seal members to contact or engage the bowl.

13 Claims, 20 Drawing Figures

CENTRIFUGE BOWL MOUNT

BACKGROUND OF THE INVENTION

1. Field of the Invention

This invention relates to a rotatable mount for securing a centrifuge in place during rotation of a centrifuge.

2. Description of the Prior Art

In maintaining or handling blood it is often necessary to perform certain processes, including centrifuging. Among the prior art devices made to meet the stringent reguirements of handling blood are the centrifuges of U.S. Pat. Nos. 3,145,713; 3,409,213; 3,565,330 and 3,317,127. The centrifuges described in these patents have applications to pumps, centrifuges, and mixing devices in general.

In one blood cell recovery system of The Haemonetics Corporation (see U.S. Pat. No. 3,785,549), proper emplacement and securing of a centrifuge bowl on a rotating centrifuge reguires both the proper seating of the bowl on the centrifuge with three locking screws in a full counterclockwise position and then the tightening of the locking screws in sequence. This device is complicated and the procedure for using it properly is complex. Also the removal procedure for removing a bowl from such a device requires a special tool (see FIG. 5, tool 70, U.S. Pat. No. 3,785,549).

Applicants submit herewith patents and references of which they are aware, which they believe may be material to the examination of this application and in respect of which there may be duty to disclose in accordance with 37 CFR 1.56; including U.S. Pat. Nos. 3,145,713; 3,317,127; 3,409,213; 3,565,330; 3,581,981; 3,634,228; 3,785,549; 4,086,924; 4,300,717; and information regarding the Haemonetics Corporation Cell Saver (Reg.T.M.) 4 cell saving system including these brochures— "Packed Cells in 3 Minutes"; "Cell Saver 4 Autologous Blood Recovery System"; and "Haemonetics For Intro-Operative, High Speed Recovery of Red Cells Using the Haemonetics (Reg.T.M.) Cell Saver 4 System Single Patient Use Sterile Fluid Path."

SUMMARY OF THE INVENTION

The present invention is directed to a new, useful and unobvious centrifuge bowl mount. The mount according to the present invention has a base for receiving, holding and securing a centrifuge bowl emplaced thereon. One or more movable toggles are disposed on the base which, in one embodiment, are movable from a first or "up" position to a second or "down" position and which in another embodiment are movable sideways to provide the desired movement. When the toggles in the one embodiment are in the "up" position, the bowl can be placed on the base. Movement of the toggles to the "down" position either: (a) moves the toggles themselves into contract with the bowl thereby assisting in holding the bowl in place; (b) moves push members which in turn contact and hold the bowl; (c) moves the push members, such as plungers or balls against a seal member disposed in the base (e.g., an O-ring), pushing the seal member or part thereof against the or into recesses in the bowl to hold the bowl in place; (d) moves the toggles themselves against a seal member disposed in the base, pushing the seal member or part thereof against the bowl or into recesses in the bowl to hold the bowl in place.

In those cases in which the bowl has a lower engageable lip formed about its exterior circumference or some other protrusion, the toggles or push members can either be moved to themselves overlap the lip or protrusion or the toggles can be moved to effect movement of a seal member or part thereof above the lip or protrusion to secure the bowl in place. When using a bowl that has a recess, indentation, or some sort of concave opening, surface, or area, the toggles or push members can be disposed to move into such recess, indentation, or opening to hold the bowl in place.

As desired, one or more reaction members such as protruding studs or the like can be utilized about the base opposite to or evenly spaced apart from the one or more toggles for balance and for better holding of the bowl. The push members can be formed with a recess conforming to the shape of a seal member (such as an O-ring). To reduce wear between the toggle and push member, the toggle can be disposed in the base apart from the push member and connected to the push member by a rod member which can pivot at the toggle and at the push member so that moving the toggle (up or down depending on the particular embodiment) imparts sideways motion to the rod and thence to the push member.

Of course the toggles could be disposed to move from one side to the other and mounted so that such sideways movement causes part of the toggle either to move into contact with the bowl or to move to push a push member either against the bowl or against a seal member as previously described. Such sideways moving toggles can be held in place after movement by an upward thrusting stud or spring loaded detent.

It is therefore an object of the present invention to provide a unique and efficient centrifuge bowl mount.

Another object of the present invention is the provsion of such a mount which is creatively simple as compared to previous mounts.

Yet another object of the present invention is the provision of such a mount which has one or more movable toggle members disposed in a base for holding a bowl, the toggle members movable to contact and hold the bowl or movable to contact push members such as plungers or balls which are in turn moved to contact and hold the bowl.

Still another object of the present invention is the provision of such a mount usable with a seal member about the mount which assists in providing secure emplacement of the bowl on the base, the toggle members or push members being movable to contact and push the seal member to enhance the holding effect of the seal member.

An additional object of the present invention is the provision of such a mount in which there are one or more reaction members spaced about the base for assisting in holding the bowl or for balancing the effect or weight of the toggle members.

A particular object of the present invention is the provision of push members which can be made to conform either to the shape of the seal member for facilitating in movement of the seal member or shaped to conform to or to be receivable in an opening, recess, or indentation in a bowl for enhancing the securing effect of the push member.

A specific object of the present invention is the provision of one or more toggles connected to push members via a rod which pivots both at the toggle and at the push member as the toggle is moved.

Another object of the present invention is the provision of centrifuge bowl mounts which have one or more such toggles movable either sideways, up-to-down, or down-to-up to effect holding of the bowl.

To one of skill in this art who has the benefits of the novel teachings of this invention, other features and advantages will be clear from the following description of preferred embodiments given for the purpose of disclosure and taken in conjunction with the drawings described below.

DESCRIPTION OF PREFERRED EMBODIMENTS

Figure 1:
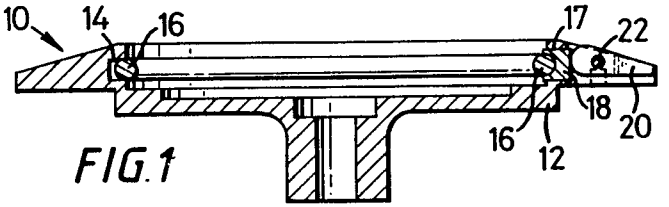
FIG. 1 is a side cross-sectional view of a base with toggle according to the present invention for receiving and holding a centrifuge bowl.
Figure 2:
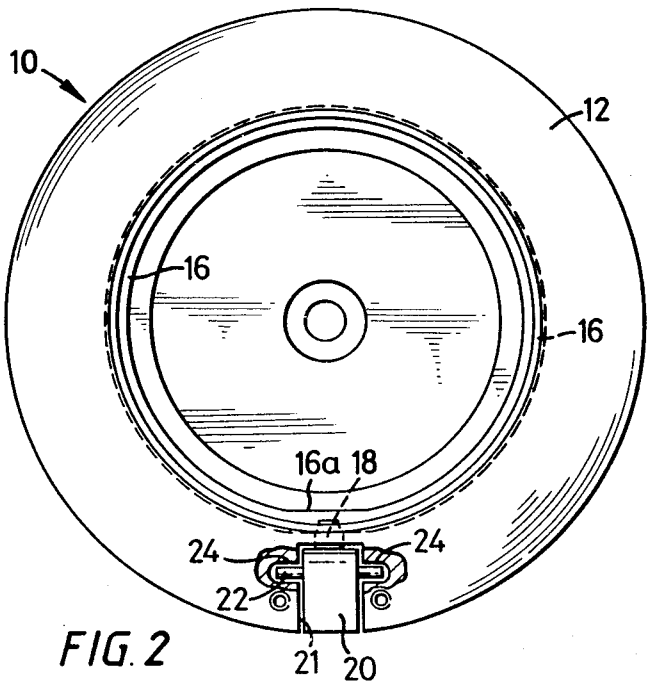
FIG. 2 is a top plan view of the base of FIG. 1, partially cutaway.
Figure 3:
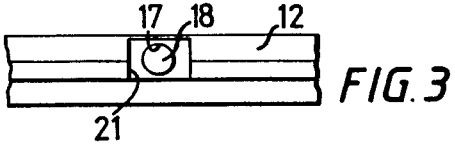
FIG. 3 is a side view of a portion of the base of FIG. 1 showing a plunger in place in a channel in the base.

As shown in FIGS. 1–4 and 6–8B, the mount 10 according to the present invention has the base 12 which has the recess 14 therein and therearound for receiving and holding the O-ring 16. The O-ring 16 is sized and configured to contactingly receive a centrifuge bowl (not shown). The plunger 18 is movably mounted in the channel 17 through the base. The toggle bar 20 is pivotally mounted to the base in the recess 21 by means of the pin 22 which extends through the toggle bar 20 and is disposed in the pin recess 24. The toggle bar 20 and the pin 22 are prevented from falling downwardly by emplacement of the bottom plate 30 (FIG. 6) over the bottom of the base 12.

Figure 4:
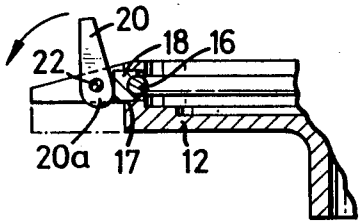
FIG. 4 is a side cross-sectional view showing a portion of the base of FIG. 1, including a toggle, plunger, and O-ring seal.

As shown in FIGS. 1 and 4, the toggle bar 20 is movable from a first or "up" position (FIG. 4) to a second or "down" position (FIG. 1). While the toggle bar 20 is in the "up" position, the O-ring 16 remains in place in the recess 14. When the toggle bar 20 is moved to the "down" position, the action of the toggle bar 20 moves the plunger 18 toward the O-ring 16, forcing the portion **16*a* of the O-ring toward the center of the base 12 (see FIG. 2). A centrifuge bowl emplaced on the base 12 will be contacted and held by the O-ring portion 16*a* which is pressed up against the bowl when the toggle bar 20** is moved to the downward position.

Figure 8A:
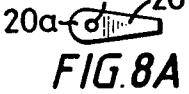
FIG. 8A is a side view of a toggle bar of FIG. 1
Figures 7A, 7B:
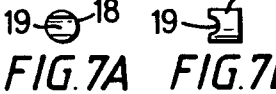
FIG. 7A is a front view of a plunger of FIG. 1
FIG. 7B is a side view of the plunger of FIG. 7A.
Figure 8B:
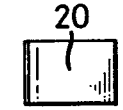
FIG. 8B is a top view of the bar of FIG. 8A.
Figure 9:
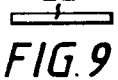
FIG. 9 is a side view of a pin for holding the toggle bar of FIG. 8A in place in the base of FIG. 1.

The plunger 18 is shown in FIGS. 7A and 7B. The plunger 18 has the recess 19 therein for receiving a portion of the O-ring 16. FIGS. 8A and 8B show the toggle bar 20. FIG. 8A is a side view and FIG. 8B is a plan view. The toggle bar 20 is shaped so that its wider end **20*a* pushes the plunger 18 toward the O-ring 16 when the toggle bar 20 is moved about the axis provided by the pin 22. As shown in FIG. 1, it is preferred that the toggle bar 22 be mountable in its recess 21 so that in the "down" position the toggle bar 20's top surface is substantially level with the surface of the base 12**.

Figure 5:
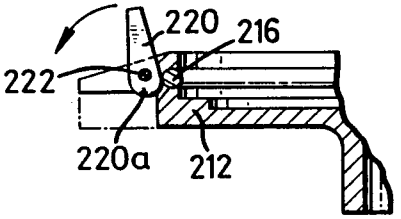
FIG. 5 is a side view in cross section showing an alternative embodiment in which a toggle is contacting an O-ring seal.

FIG. 5 shows an alternative toggle bar arrangement according to the present invention in which the toggle bar 212 itself moves into contact with the O-ring 216 mounted in the base 212. Movement of the toggle bar 220 from an "up" position to a "down" position will cause the partial revolution of the wide end **220*a* of the toggle bar 220 about the pin 222 thereby moving the O-ring 216 toward the center of the base 212 an amount egual to the difference in the radius of the toggle bar 220 at the point of contact with the O-ring (as shown in FIG. 5) and the radius of the wide end 220*a*. This movement is sufficient to move the O-ring against a bowl emplaced on the base 212**; or over a lip on such a bowl; or into a recess in such a bowl.

Figure 11:
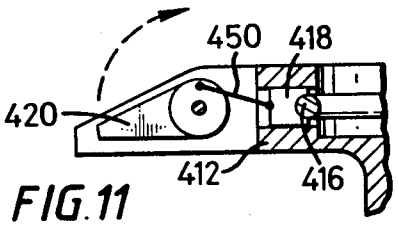
FIG. 11 is a side view in cross section of an alternative toggle embodiment showing a toggle bar disposed apart from a plunger and connected thereto by a rod which pivots both at the bar and at the plunger.
Figure 10:
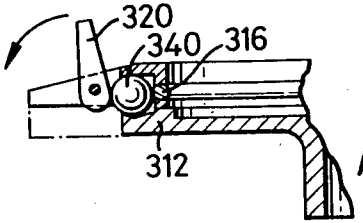
FIG. 10 is a side view in cross section of an alternative toggle embodiment showing a ball member movable to contact and move an O-ring.

Similarly FIGS. 10, 11, 14, and 16 show alternative toggle arrangements according to the present invention. As shown in FIG. 10, the toggle bar 320 when moved to a "down" position will move the ball 340 toward the O-ring 316 pushing it toward the center of the base 312. As shown in FIG. 11, movement upwardly of the toggle bar 420 pushes the rod 450 (which is pivotally connected to the bar 420) toward the plunger 418 (to which the rod 450 is also pivotably connected) thereby moving the plunger 418 and the O-ring 416 toward the center of the base 412. Although it is more preferred that the toggle bars move from "up" to "down", as illustrated in FIG. 10, they can move from "down" to "up" (as shown in FIG. 11) according to the present invention. Of course the connections of the rod 450 can be changed to provide an "up" to "down" activating movement of the toggle bar 420.

Figure 14:
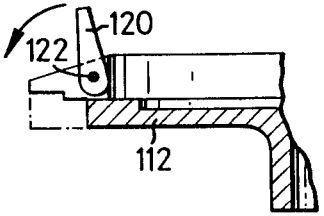
FIG. 14 is a side cross-sectional view of a portion of a base according to the present invention showing a toggle member which is movable to contact a bowl placed on the base.

As shown in FIG. 14, a toggle bar alone such as bar 120 can be employed to move to contact a bowl placed on the mount 112. The bar 120 is movable about the pin 122 therethrough.

Figure 16:
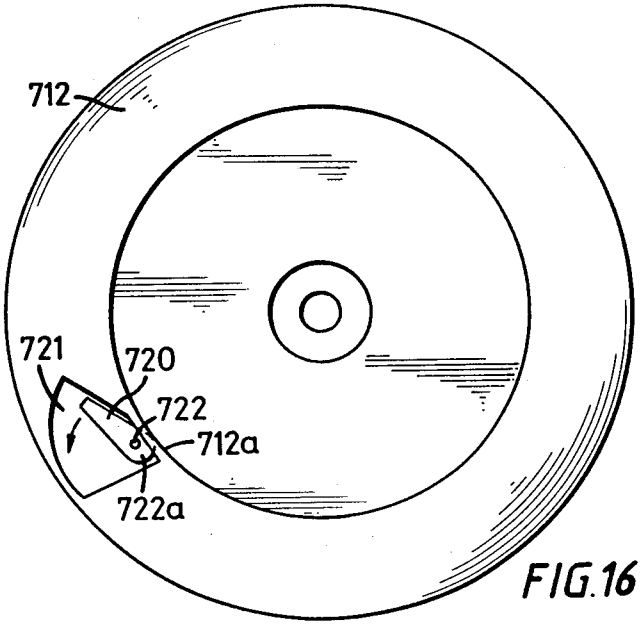
FIG. 16 is a top view of a base according to the present invention showing a sideways movable toggle.

As shown in FIG. 16, the toggle bar 120 is mounted in the recess 721 in the base 712. The bar 720 is movable sideways about the pin 722. Such movement will cause the wide end 722*a* of the bar 720 to protrude beyond the edge 712*a* to contact a bowl placed on the base 712 and to thereby enhance the holding of the bowl on the base.

Figure 12:
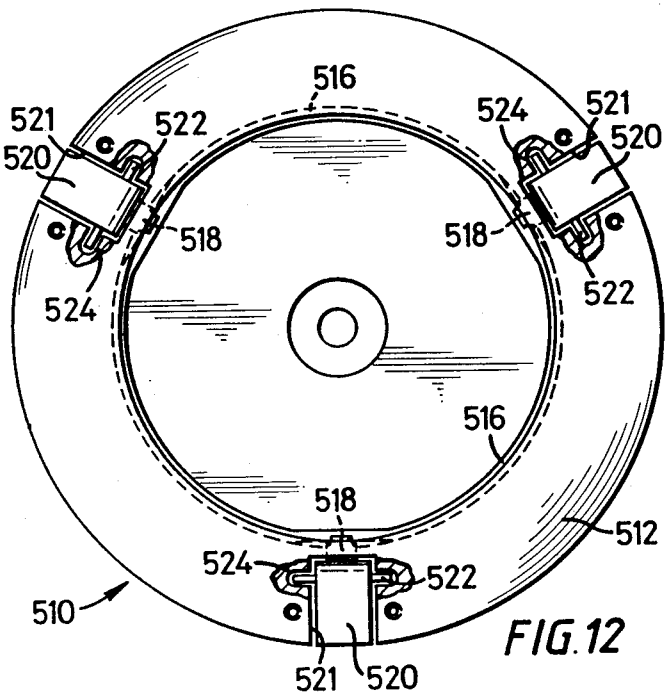
FIG. 12 is a plan view, partially cutaway, of a base according to the present invention having three toggle members spaced evenly about the base and in the "down" position showing the pushed-in portions of the O-ring seal.
Figure 6:
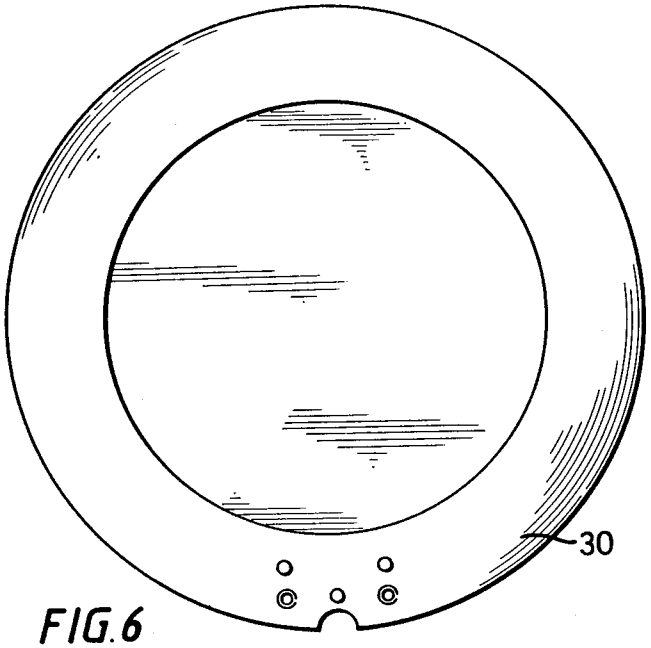
FIG. 6 is a plan view of a bottom plate to be mounted beneath the base of FIG. 1 to hold the various toggles in place.

FIG. 12 illustrates an embodiment of the mount 510 according to the present invention in which there are three toggle bars 520 equidistantly spaced about the base 512. As shown, the toggle bars 520 (in the recesses 521) have been moved to a "down" position (on the pins 522 movably mounted in the recesses 524) and the plungers 518 have moved portions of the O-ring 516 toward the center of the base 512.

Figure 13:
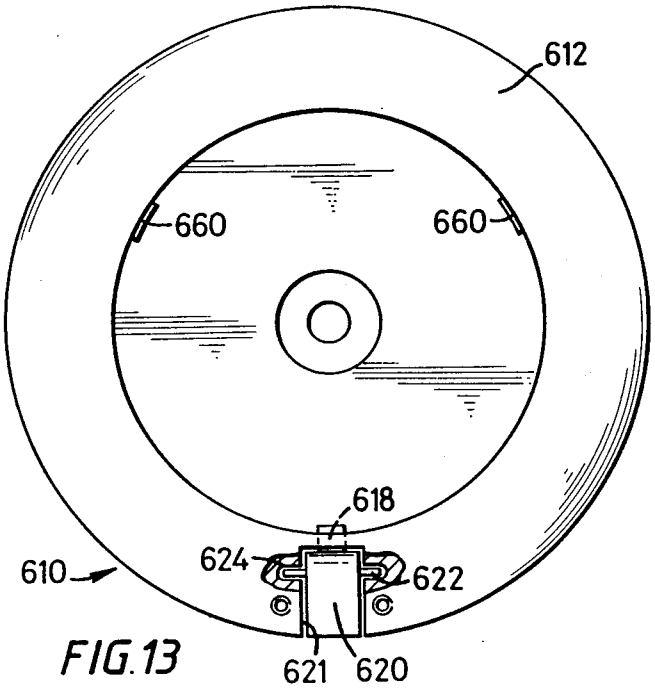
FIG. 13 is a plan view, partially cutaway, showing a base according to the present invention having one toggle and two reaction studs spaced about the base.

FIG. 13 illustrates an embodiment of the mount 610 according to the present invention in which there is no O-ring on the base 612 The toggle bar 620 mounted in the recess 621 and mcvable about the pin 622 (in the recess 624) has been moved to the "down" position pushing the plunger 618 toward the center of the base 612. The studs 660 connected to the base 612 enhance the holding of a bowl on the base 612 and help to balance the toggle members. Both the studs and the plunger 618 can be disposed and configured to accommodate any of the types of bowl shown in FIGS. 15A, 15B, or 15C (as can each of the mounts and toggle arrangements disclosed herein). As desired such studs can be employed with any of the mounts disclosed herein.

Figure 15B:
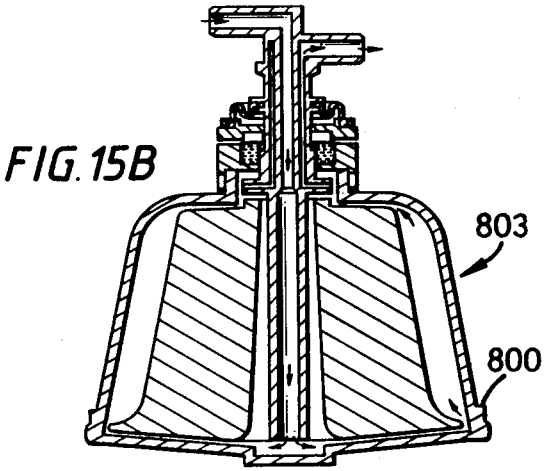
FIG. 15B shows a side view in cross section of a prior art bowl which has a lip about its lower circumference.
Figure 15C:
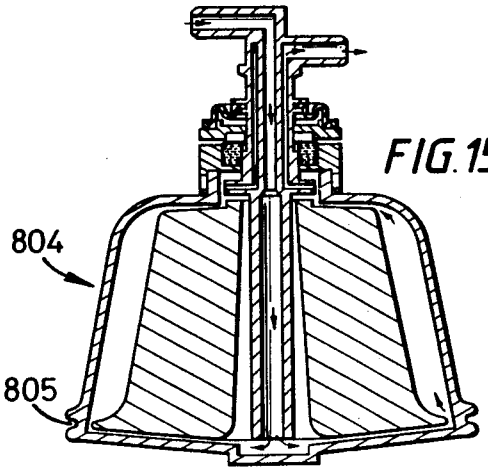
FIG. 15C shows a side view in cross section of a bowl which has a recess about its lower circumference.
Figure 15A:
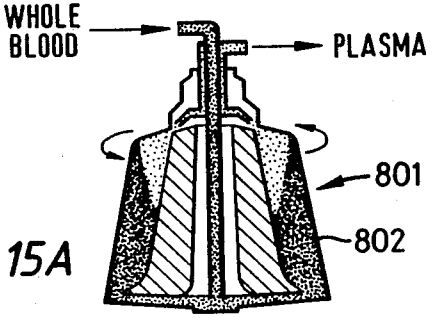
FIG. 15A shows a side view in cross section of a prior art bowl which has smooth sides.

FIGS. 15A, 15B, and 15C illustrate the various centrifuge bowls which the mounts according to the present invention can effectively secure (although the use of mounts according to this invention are not limited to the specific shapes and configurations of bowls shown in FIGS. 15A, 15B, or 15C).

FIG. 15A shows a centrifuge bowl 801 as disclosed in U.S. Pat. No. 4,086,924 which has smooth tapered sides 802.

FIG. 15B shows a centrifuge bowl 803 as disclosed in U.S. Pat. No. 4,300,717 which has an upwardly projecting lip 800 about its lower circumference.

FIG. 15C shows a centrifuge bowl 804 which has the recess 805 formed about the bowl's lower circumference.

At the present time it is preferred that mount bases, bottom plates and toggle bars be made from high strength aluminum and that the toggle bars be coated with TUFRAM (TM). It is preferred that plungers be made of DELRIN (TM) or RULON (TM) or some other such plastic. It is preferred that the pins used through the toggle bars be made of stainless steel for corrosion resistance. The inertia of the mount is critical to start/stop time based on motor parameters so it may be advantageous to fabricate parts of the mount from plastic.

The present invention, therefore, is well adapted to carry out the objects and attain the ends and advantages mentioned as well as others inherent therein. While presently preferred embodiments of the invention has been given for the purpose of disclosure, numerous changes in the details of construction and arrangement of parts will be readily apparent to those skilled in the art who have the benefit of this invention's headings and which are encompassed within the spirit of the invention and the scope of the appended claims.

What is claimed is:

1. A centrifuge bowl mount for holding a centrifuge bowl, the mount comprising, base means for receiving said bowl, seal means disposed within said base means and configured to sealingly contact said bowl upon receipt of said bowl by said base means, toggle means movably connected to said base means and disposed so that said toggle means is movable into contact with said seal means thereby forcing said seal means against said bowl to secure said bowl on said base means.

2. The mount of claim 1 wherein toggle means comprises, push means movably disposed in channel means, said channel means formed through said base means, said push means disposed adjacent said seal means and movable to contact said seal means, toggle bar means movably connected to said base means so that upon movement thereof said toggle bar means moves said push means in said channel means thereby forcing said seal means against said bowl to secure said bowl on said mount.

3. The mount of claim 2 wherein said push means is plunger means conforming in shape to said channel means.

4. The mount of claim 3 wherein said plunger means is indented to conform to and receive a portion of said seal means.

5. The mount of claim 3 wherein said toggle bar means is connected to said plunger means by rod means extending therebetween, said rod means pivotably connected to both said toggle bar means and said plunger means.

6. The mount of claim 2 wherein said push means is ball means movable by action of the toggle bar means to contact said seal means.

7. The mount of claim 2 wherein there is a plurality of push means and corresponding toggle bar means.

8. The mount of claim 2 wherein there is one push means and one toggle bar means.

9. The mount of claim 8 wherein reaction means are mounted on said base means for assisting in holding said bowl.

10. The mount of claim 1 wherein said bowl has lip means and said toggle means is movable to move a portion of said seal means over said lip means to enhance the holding of the bowl on the mount.

11. The mount of claim 1 wherein said bowl means has recess means therein and said toggle means is movable to move a portion of said seal means into said recess means to enhance the holding of said bowl on said mount.

12. A centrifuge bowl mount for holding a centrifuge bowl, the mount comprising, base means for receiving said bowl, toggle means movably connected to said base means, said toggle means disposed so that said toggle means is movable from a first position to a second position in which said toggle means contacts said bowl to hold said bowl on said mount, and said base means having recess means therein for receiving said toggle means and for holding said toggle means substantially immoblile during rotation of said bowl.

13. A centrifuge bowl mount for holding a centrifuge bowl, the mount comprising, base means for receiving said bowl, toggle means movably connected to said base means, said toggle means disposed so that said toggle means is movable from a first position to a second position in which said toggle means contacts said bowl to hold said bowl on said mount, said bowl having recess means therein and said toggle means movable to move part of said toggle means into said recess means.

* * * * *